US007972983B2

(12) United States Patent
Taylor et al.

(10) Patent No.: US 7,972,983 B2
(45) Date of Patent: Jul. 5, 2011

(54) INTERLOCK DOUBLE WEAVE FABRIC AND METHODS OF MAKING AND USING THE SAME

(75) Inventors: Don Taylor, New Braunfels, TX (US); Bryan Loeper, Austin, TX (US); David Henderson, Seguin, TX (US)

(73) Assignee: Hexcel Corporation, Dublin, CA (US)

( * ) Notice: Subject to any disclaimer, the term of this patent is extended or adjusted under 35 U.S.C. 154(b) by 1127 days.

(21) Appl. No.: 10/979,574

(22) Filed: Nov. 2, 2004

(65) Prior Publication Data

US 2005/0098224 A1 May 12, 2005

Related U.S. Application Data

(60) Provisional application No. 60/517,959, filed on Nov. 6, 2003.

(51) Int. Cl.
*B32B 5/02* (2006.01)
*D03D 15/00* (2006.01)

(52) U.S. Cl. ..... 442/239; 442/179; 442/217; 442/228; 442/229; 442/242

(58) Field of Classification Search ..... 73/760, 73/768; 139/110, 383 A, 387 R, 388, 408, 139/410, 413, 414, 415, 420 R, 425 A, 425 R, 139/426 TW; 162/348, 100, 109, 900, 902, 162/903; 219/545, 212, 529, 549; 338/208, 338/212; 428/116, 152, 357, 364, 365, 367, 428/375, 379, 408, 902, 922; 442/119, 205, 442/210, 229, 5, 20, 203, 206, 207, 217, 442/240, 243, 256, 311, 318, 6, 21, 179, 442/341, 228, 239, 242

See application file for complete search history.

(56) References Cited

U.S. PATENT DOCUMENTS

| | | | | |
|---|---|---|---|---|
| 2,272,229 | A * | 2/1942 | Tucker | 28/169 |
| 3,755,713 | A | 8/1973 | Paszkowski | |
| 4,085,012 | A | 4/1978 | Marceau et al. | |
| 4,352,142 | A | 9/1982 | Olson | |
| 4,368,234 | A | 1/1983 | Palmer et al. | |
| 4,429,341 | A | 1/1984 | King | |
| 4,448,838 | A * | 5/1984 | McClenahan et al. | 442/229 |
| 4,502,092 | A | 2/1985 | Bannink, Jr. et al. | |
| 4,522,889 | A | 6/1985 | Ebneth et al. | |
| 4,567,094 | A | 1/1986 | Levin | |
| 4,590,122 | A * | 5/1986 | Levin | 442/210 |
| 4,621,663 | A * | 11/1986 | Malmendier | 139/383 A |

(Continued)

FOREIGN PATENT DOCUMENTS

DE 33 29 740 A1 * 3/1985

(Continued)

OTHER PUBLICATIONS

Chung, D.D.L. (1994). Carbon Fiber Composites. (pp. 3-11 & 65-78). Elsevier. Online version available at: http://www.knovel.com/knovel2/Toc.jsp?BookID=517&VerticalID=0.*

(Continued)

*Primary Examiner* — D. Lawrence Tarazano
*Assistant Examiner* — Matthew Matzek
(74) *Attorney, Agent, or Firm* — Withers & Keys, LLC

(57) ABSTRACT

Woven fabrics suitable for use as a lightning strike material are disclosed. Methods of making woven fabrics are also disclosed. Methods of using woven fabrics are further disclosed.

35 Claims, 3 Drawing Sheets

U.S. PATENT DOCUMENTS

| | | | | | |
|---|---|---|---|---|---|
| 4,755,904 | A | * | 7/1988 | Brick | 361/117 |
| 4,793,903 | A | | 12/1988 | Holmquist et al. | |
| 5,089,325 | A | | 2/1992 | Covey | |
| 5,127,601 | A | | 7/1992 | Schroeder | |
| 5,132,168 | A | * | 7/1992 | Meyn et al. | 442/186 |
| 5,160,485 | A | * | 11/1992 | Jaillet et al. | 428/116 |
| 5,222,297 | A | | 6/1993 | Graff et al. | |
| 5,263,516 | A | * | 11/1993 | van Schuylenburch | 139/411 |
| 5,286,553 | A | * | 2/1994 | Haraguchi et al. | 442/199 |
| 5,370,921 | A | | 12/1994 | Cedarleaf | |
| 5,482,567 | A | * | 1/1996 | Barreto | 139/383 A |
| 5,538,781 | A | | 7/1996 | Rao et al. | |
| 5,641,001 | A | * | 6/1997 | Wilson | 139/383 A |
| 5,958,578 | A | | 9/1999 | Blohowiak et al. | |
| 6,277,771 | B1 | * | 8/2001 | Nishimura et al. | 442/229 |
| 6,354,335 | B1 | * | 3/2002 | Taipale et al. | 139/383 A |
| 6,436,507 | B1 | | 8/2002 | Pannell | |
| 6,521,296 | B1 | | 2/2003 | Seal et al. | |
| 6,883,556 | B2 | * | 4/2005 | Fahrer et al. | 139/383 A |

FOREIGN PATENT DOCUMENTS

| | | |
|---|---|---|
| EP | 0507108 | 7/1992 |
| GB | 2155062 A | 9/1985 |

OTHER PUBLICATIONS

Triplett, T.E., "Lightning Strike Protection Concepts for Composite Materials", 34th Int'l Sampe Symposium, May 8-11, 1989, pp. 1656-1667.

* cited by examiner

INTERLOCK DOUBLE WEAVE FABRIC AND METHODS OF MAKING AND USING THE SAME

CROSS-REFERENCE TO RELATED APPLICATIONS

This patent application claims the benefit of priority to U.S. provisional patent application Ser. No. 60/517,959 entitled "INTERLOCK DOUBLE WEAVE FABRIC AND METHODS OF MAKING AND USING THE SAME" filed on Nov. 6, 2003, the subject matter of which is incorporated herein in its entirety.

FIELD OF THE INVENTION

The present invention is directed to woven fabrics suitable for use as a lightning strike material. The present invention is further directed to methods of making and using such woven fabrics.

BACKGROUND OF THE INVENTION

There is a need in the art for woven fabrics capable of providing one or more properties including, but not limited to, lightning strike resistance, matrix reinforcement, structural support, insulation, heat resistance, conductivity, and weight reduction.

SUMMARY OF THE INVENTION

The present invention addresses some of the needs in the art discussed above by the discovery of an interwoven fabric. The interwoven fabric of the present invention may comprise (i) a variety of materials and (ii) an interwoven structure to provide one or more of the above-mentioned desirable properties.

In one exemplary embodiment of the present invention, the interwoven fabric comprises (a) a first set of m warp ends, (b) a second set of n warp ends, (c) a first set of y fill ends, and (d) a second set of z fill ends, wherein (i) one or more ends within the first set of warp ends are interwoven with one or more ends within the first set of fill ends to form a first fabric, (ii) one or more ends within the second set of warp ends are interwoven with one or more ends within the first set of fill ends to form a second fabric, (iii) at least one end within the first set of warp ends is interwoven with at least one end within the second set of fill ends to join the first fabric to the second fabric, and (iv) at least 50 percent by weight of the first fabric is positioned above the second fabric. In one desired embodiment of the present invention, the interwoven fabric comprises a first fabric of metal wires interwoven with a second fabric of carbon tows.

In a further exemplary embodiment of the present invention, the interwoven fabric comprises (a) metal wire warp ends interwoven with metal wire fill ends to form a first fabric, (b) carbon tow warp ends interwoven with carbon tow fill ends to form a second fabric, wherein at least one end of the first fabric is interwoven with at least one end of the second fabric, and at least 50 percent by weight of the first fabric is positioned above the second fabric.

The present invention is further directed to fiber-reinforced materials comprising (i) the above-described interwoven fabric, (ii) one or more optional, additional fiber-containing layers, and (iii) a matrix material in contact with the interwoven fabric and the optional fiber-containing layers. The matrix material may comprise a variety of matrix materials including, but not limited to, thermosettable resins, thermoset resins, thermoplastic resins, metals, ceramics, concrete, or any other matrix material. The fiber-reinforced materials may be incorporated into a variety of articles, such as aircraft components.

The present invention is also directed to methods of making the above-described interwoven fabric and fiber-reinforced materials containing the same. In one exemplary embodiment of the present invention, the method of making an interwoven fabric comprises the steps of weaving (a) a first set of m warp ends, (b) a second set of n warp ends, (c) a first set of y fill ends, and (d) a second set of z fill ends to form the interwoven fabric, wherein: (i) one or more ends within the first set of warp ends are interwoven with one or more ends of the first set of fill ends to form a first fabric, (ii) one or more ends within the second set of warp ends are interwoven with one or more ends of the first set of fill ends to form a second fabric, (iii) at least one end within the first set of warp ends is interwoven with at least one end of the second set of fill ends to join the first fabric to the second fabric, and (iv) at least 50 percent by weight of the first fabric is positioned above the second fabric.

In addition, the present invention is directed to methods of using the above-described interwoven fabric and fiber-reinforced materials containing the same. In one desired embodiment of the present invention, the above-described interwoven fabric is used as a lightning strike material forming an outer surface of an aircraft.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to an interwoven fabric comprising a first woven fabric interlocked with a second woven fabric. The present invention is further directed to methods of making the interwoven fabric, as well as, methods of using the interwoven fabric to form fiber-containing articles of manufacture. The present invention is even further directed to fiber-containing articles of manufacture comprising at least one layer of interwoven fabric and optionally a matrix material in contact with the layer of interwoven fabric.

The interwoven fabric of the present invention possesses a unique fabric construction and a variety of fabric materials resulting in an interwoven fabric having one or more desirable fabric features. A detailed description of the interwoven fabric of the present invention is given below.

I. The Interwoven Fabric

The interwoven fabrics of the present invention possess a number of physical features, which contribute to one or more of the following desirable properties: lightning strike resistance, EMI shielding, matrix reinforcement, structural support, insulation, heat resistance, conductivity, and weight reduction.

A. Physical Features of the Interwoven Fabric

Figure 1:
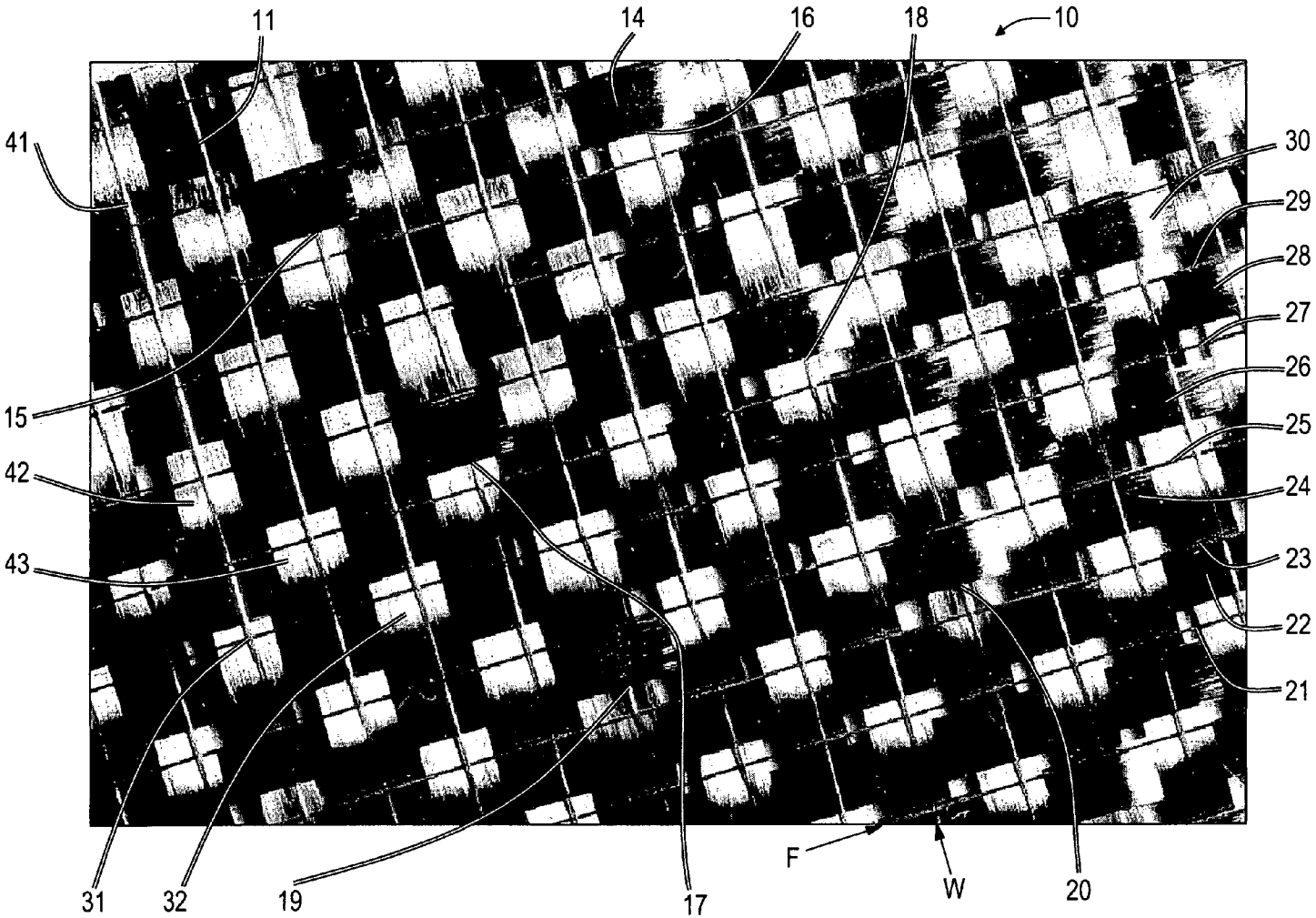
FIG. 1 depicts an exemplary fabric of the present invention comprising a first woven fabric of metal wires interwoven with a second woven fabric of carbon tows.

The physical features of the interwoven fabric of the present invention may be described by referring to exemplary interwoven fabric 10 as shown in FIG. 1. Exemplary interwoven fabric 10 shown in FIG. 1 comprises a first fabric 31 of metal wires (i.e., C51000 (also referred to in abbreviated form as "C510") Phosphor Bronze wire available from Fisk Alloy Wire, Inc., Hawthorne, N.J., having a wire diameter of 0.004" and an IACS value of ~13%) interwoven with a second fabric 32 of carbon tows (i.e., IM7 6K carbon tow available from Hexcel Corporation, Stamford, Conn.). Arrows W and F shown in FIG. 1 indicate the warp direction and the fill direction respectively of exemplary interwoven fabric 10. A number of factors contribute to the physical features of the interwoven fabric of the present invention as described below.

1. Weave Construction

The interwoven fabric of the present invention comprises a complex weave construction. The complex weave construction may contain three separate weave pattern components: (1) a first weave pattern of the first fabric, (2) a second weave pattern of the second fabric, and (3) a third weave pattern for the interlocking weave joining the first fabric to the second fabric. Each of the three separate weave pattern components may independently comprise any known weave pattern including, but not limited to, a plain weave pattern, a twill weave pattern, a satin weave pattern, a reverse twill weave pattern, a rib weave pattern, a honeycomb weave pattern, a leno weave pattern, a mock leno weave pattern, etc.

As shown in FIG. 1, exemplary interwoven fabric 10 comprises a first fabric 31 having a plain weave pattern, and a second fabric 32 also having a plain weave pattern. The plain weave pattern of first fabric 31 may be recognized by the following: (i) metal wire warp end 41 alternates over and under adjacent metal wire fill ends, (ii) adjacent metal wire warp end 11 (i.e., adjacent to metal wire warp end 41) alternates under and over the same metal wire fill ends, and (iii) the plain weave pattern repeats as one moves to the right in the fill direction F from metal wire warp end 11. Likewise, the plain weave pattern of second fabric 32 may be recognized by the following: (i) carbon tow warp end 42 alternates over and under adjacent carbon tow fill ends, (ii) adjacent carbon tow warp end 43 (i.e., adjacent to carbon tow warp end 42) alternates under and over the same carbon tow fill ends, and (iii) the plain weave pattern repeats as one moves to the right in the fill direction F from carbon tow warp end 43.

Exemplary interwoven fabric 10 shown in FIG. 1 comprises first fabric 31 having a plain weave pattern, second fabric 32 having a plain weave pattern, and an interlocking weave having a twill weave pattern. As shown in FIG. 1, every fourth metal warp end is interlocked with a carbon tow fill end in a repeating pattern. For example, carbon tow fill end 14 interlocks with metal warp ends of first fabric 31 at locations 15 and 16 within interlock fabric 10. The interlock weave pattern of exemplary interwoven fabric 10 follows a twill interlock pattern as noted by the following fabric construction features: (i) the interlock pattern moves over one warp end in a repeating pattern as every sixth fill end (i.e., three metal wire fill ends and three carbon tow fill ends) is inserted into the interwoven fabric (see, for example, fill ends 24-30 of exemplary interwoven fabric 10), (ii) one interlocking fill end, carbon tow fill end 14, interlocks first fabric 31 to second fabric 32 at locations 15 and 16, (iii) the next interlocking fill end (moving downward in the warp direction W), carbon tow fill end 30, interlocks first fabric 31 to second fabric 32 at locations 17 and 18, and (iv) the next interlocking fill end, carbon tow fill end 24, interlocks first fabric 31 to second fabric 32 at locations 19 and 20.

As shown in exemplary interwoven fabric 10, as one moves along the warp direction W of exemplary interlock fabric 10, the interlock locations between first fabric 31 and second fabric 32 moves over one warp end and repeats an interlocking pattern every sixth fill end. It should be understood that the degree of interlocking between first fabric 31 and second fabric 32 may be increased or decreased depending on a number of factors including, but not limited to, the end use of the interwoven fabric. For example, the interlocking weave pattern may only interlock every tenth or twentieth warp end within first fabric 31. In addition, the interlocking weave pattern may only repeat itself after every eighth or sixteenth fill end is inserted into the interwoven fabric (as opposed to every sixth fill end as shown in exemplary interwoven fabric 10).

As discussed above, the interlocking weave pattern may comprise a weave pattern other than the interlocking twill weave pattern shown in exemplary interwoven fabric 10. For example, an interlocking plain weave pattern could be used, wherein the same warp ends of first fabric 31 are repeatedly interwoven with fill ends of second fabric 32.

2. Interwoven Fabric Density

The interwoven fabric of the present invention may have a fabric density that varies depending on a number of factors including, but not limited to, the type of ends used within first fabric 31, the type of ends used within second fabric 32, and the end use of the interwoven fabric. In one exemplary embodiment of the present invention, the interwoven fabric comprises up to about 100 total ends per inch (i.e., ends within first fabric 31 and ends within first fabric 32) in the warp direction, the fill direction, or both directions of the interwoven fabric. In other exemplary embodiments of the present invention, the interwoven fabric comprises from about 2 to about 60 total ends per inch in the warp direction, the fill direction, or both directions of the interwoven fabric.

The distribution of ends within first fabric 31 versus second fabric 32 may be equal or unequal. In other words, it may be desirable for the first fabric to have a relatively low fabric density (e.g., 1 to 3 ends/inch) in the warp direction, the fill direction, or both directions of the first fabric, while the second fabric has a relatively high fabric density (e.g., 24 to 60 ends/inch) in the warp direction, the fill direction, or both directions of the second fabric. In other embodiments of the present invention, it may be desirable for the first fabric to have a relatively high fabric density (e.g., 24 to 60 ends/inch) in the warp direction, the fill direction, or both directions of the first fabric, while the second fabric has a relatively low fabric density (e.g., 1 to 4 ends/inch) in the warp direction, the fill direction, or both directions of the second fabric.

In one desired embodiment of the present invention, the distribution of ends between first fabric 31 and second fabric 32 is substantially equal, and the number of total ends per inch ranges from about 12 to about 26 ends/inch in both the warp and fill directions of the interwoven fabric (i.e., from about 6 to about 13 end/inch in both the warp and fill directions of each of the first fabric 31 and the second fabric 32). More desirably, the number of total ends per inch ranges from about 18 to about 24 ends/inch in both the warp and fill directions of the interwoven fabric (i.e., from about 9 to about 12 end/inch in both the warp and fill directions of each of the first fabric 31 and the second fabric 32).

3. Position of the First Fabric Relative to the Second Fabric within the Interwoven Fabric The above-described weave construction of the interwoven fabric of the present invention enables the production of interwoven fabrics having a large percentage of the first fabric positioned above the second fabric of the interwoven fabric. As shown in FIG. 1, exemplary interwoven fabric 10 comprises first fabric 31, a majority of which is positioned on top of second fabric 32. It should be noted that the warp and fill metal wire ends of first fabric 31 are all positioned on top of warp and fill carbon tow ends of second fabric 32. Even at interlocking locations 15, 16, 17, 18, 19, and 20, metal wire warp ends within first fabric 31 are positioned on top of corresponding carbon tow warp ends within second fabric 32. In such a fabric construction, the back side of exemplary interwoven fabric 10 (not shown) is substantially free, and desirably, completely free, of any portion of first fabric 31. In other words, an outer surface of exemplary interwoven fabric 10 comprises 100% of second fabric 32.

It should be further noted that in exemplary interwoven fabric 10 all portions of warp and fill metal wire ends within first fabric 31 are positioned above second fabric 32 except for portions of metal wire warp ends of first fabric 31 that are interlocked with fill ends of second fabric 32 such as shown at locations 15, 16, 17, 18, 19 and 20 within exemplary interwoven fabric 10. Such a fabric construction enables the production of interwoven fabrics having a high degree of first fabric materials positioned above the materials of the second fabric yet still be interlocked with the second fabric.

In one exemplary embodiment of the present invention, at least 50 percent by weight (pbw) of the first fabric is positioned above the second fabric of the interwoven fabric. In the interwoven fabrics of the present invention, the amount of first fabric positioned above the second fabric may be as high as 99 percent by weight (pbw) of the first fabric. Desirably, the interwoven fabrics of the present invention are constructed to have at least 50 pbw of the first fabric positioned above the second fabric, more desirably, at least 70 (75, 80, 85, 90, 95) pbw of the first fabric positioned above the second fabric of the interwoven fabric.

It should be noted that in exemplary interwoven fabric 10 none of the metal wire fill ends within first fabric 31 is interwoven with carbon tow warp ends of second fabric 32. Such a fabric construction increased the amount of first fabric 31 positioned above second fabric 32. However, it should be understood that the present invention also encompasses interwoven fabrics, which may possess some desired degree of interlocking between the fill ends of first fabric 31 and the warp ends of second fabric 32.

In a further embodiment of the present invention, a first fabric of metal wires is interwoven with a second fabric comprising a primary component in the form of carbon tow ends and a secondary component of glass tracer yarns. In this embodiment, the glass tracer yarns may be present in an amount of up to about 50%, more desirably, in a minimal amount solely for interlocking with the first fabric. Such a fabric construction enables 100% of the metal wires to be above the primary component (i.e., the carbon tow component) of the second fabric. It should be understood that the above combination of primary and secondary components may comprise any other combination of materials.

B. Fabric Construction

The interwoven fabrics of the present invention may comprise one or more types of material to form the first fabric and the second fabric of the interwoven fabric. In one exemplary embodiment of the present invention, the first fabric and the second fabric of the interwoven fabric together comprise a single type of material, such as a carbon or graphite yarn or tow. In a further embodiment of the present invention, the first fabric may comprise a first material, and the second fabric may comprise a second material, wherein the second material is different from the first material (e.g., exemplary interwoven fabric 10 of FIG. 1). In still further embodiments of the present invention, one or both of the first and second fabrics may comprise two or more different types of material (e.g., metal wires and carbon tows may be used in both the first and second fabrics or metal wires may be used in the first fabric while carbon tows and glass yarns are used in the second fabric).

Suitable materials for use in the interwoven fabrics of the present invention include, but are not limited to, metal wire, carbon tows (or fibers or yarns), aramid fibers or yarns, fiberglass fibers or yarns, quartz fibers or yarns, NOMEX® fibers or yarns, ceramic fibers or yarns, polymeric yarns, fibers or filaments, or a combination thereof. The carbon tows may be polyacrylonitrile (PAN) or pitch derived carbon tows. In one desired embodiment of the present invention, the interwoven fabric comprises metal wires in combination with carbon tows. A description of exemplary metal wires and carbon tows for use in the present invention is given below.

1. Metal Wires

A variety of metal wires may be used in the present invention. Suitable metal wires include, but are not limited to, phosphor bronze wire, copper wire, nickel/copper alloy wire, and nickel-plated copper wire. Specific metal wires suitable for use in the present invention include, but are not limited to, C51000 Phosphor Bronze wires, C52100 Phosphor Bronze wires, C52400 Phosphor Bronze wires, C72500 NiCu Alloy wires, C11000 Ni plated Cu wires, C48600 CuZnSn Alloy wires, and C10200 Cu wires. Any of the above-referenced metal wires may be "hard drawn" wire or "annealed" wire. Further, any of the above-referenced metal wires may be used in the form of a single wire or may be used in combination with other identical or different wires to form plied wires having up to about six individual wires within a given plied wire.

In one embodiment of the present invention, the metal wires used to form the interwoven fabric of the present invention possess a desired degree of electrical conductivity as determined using the IACS (International Annealed Copper Standard) system. The metal fibers desirably possess an electrical conductivity of at least 8% IACS. In some embodiments of the present invention, the metal fibers have an electrical conductivity of from about 9% IACS to about 20% IACS. In other embodiments of the present invention, the metal wires desirably have an electrical conductivity of greater than about 95% IACS, more desirably, from about 98% to 100% IACS.

A number of commercially available metal wires may be used in the present invention. Suitable commercially available metal wires include, but are not limited to, a C51000 phosphor bronze wire (either hard drawn or annealed) (~13-15% IACS), a 75/25 Ni/Cu alloy wire (88 wt % Cu; 2 wt % Sn; 10 wt % Ni) (~9-11% IACS), and nickel-plated copper wire comprising about 96 wt % Cu and about 4 wt % Ni (~98-100% IACS). The above-mentioned commercially available metal wires are available from at least the following sources: California Fine Wire Co. (Grover Beach, Calif.); A-1 Wire Tech, Inc. (Rockford, Ill.) Torpedo Specialty Wire, Inc. (Rocky Mount, N.C.); Pelican Wire Co., Inc. (Naples, Fla.); Fisk Alloy Wire, Inc. (Hawthorne, N.J.); ACI Alloys (San Jose, Calif.); Polymet Corp. (Cincinnati, Ohio); Radcliff Wire, Inc. (Bristol, Conn.); and R&F Alloy Wires, Inc. (Fairfield, N.J.).

In one desired embodiment of the present invention, the first fabric of the interwoven fabric comprises nickel-plated copper wires. Nickel-plated copper wires provide a number of advantages over other metal wires including, but not limited to, corrosion resistance, a high degree of electrical conductivity (greater than 95% IACS), and potentially enhanced bonding to some matrix materials, such as some epoxy resins. In one desired embodiment of the present invention, all warp and fill ends within the first fabric of the interwoven fabric comprise nickel-plated copper wires.

The metal wires may have any known cross-sectional configuration. Typically, the metal wires used in the present invention have a substantially round cross-sectional configuration. Alternatively, the metal wires may have a cross-sectional configuration selected from any of the following cross-sectional configurations: elliptical, triangular, square, rectangular, rhombus, etc.

Any of the above-mentioned metal wires may desirably have an average wire diameter of up to about 20 mil (0.020 in). Typically, the metal wires used in the present invention have an average wire diameter ranging from about 1 mil to about 8 mil, desirably, from about 1 mil to about 5 mil, more desirably, from about 3 mil to about 5 mil. As discussed above, one or more individual metal wires may be plied with other metal wires to form plied wires. Typically, the plied metal wires have an average plied wire diameter of up to about 30 mil.

2. Carbon or Graphite Tows

Any available carbon or graphite tows may be used in the present invention. Typically, the carbon tows have from about 1,000 (1K) to about 24,000 (24K) filaments per tow, and a modulus ranging from about 31 Msi (million pounds per square inch) to 130 Msi. In one desired embodiment of the present invention, the carbon tows comprise 6K (i.e., 6,000 filaments per tow) carbon tows having a standard to ultra high modulus. In other embodiments of the present invention, the carbon tows comprise carbon tows including, but are not limited to, standard modulus 6K yarn, high modulus 6K yarn, standard modulus 3K yarn, and high modulus 3K yarn.

The carbon tows used in the present invention typically comprise a sizing composition coated onto at least a portion of an outer surface of filaments within the carbon tow when received from the manufacturer. Suitable sizing compositions include, but are not limited to, G, GP, H, S, R, and GS sizing compositions from Hexcel Corporation (Stamford, Conn.); 1, 2, 3, 4, 5, 6, F and 9 sizing compositions from Toray Industries, Inc. (Tokyo, JP); UC309 and AP200 sizing compositions from Cytec Industries, Inc. (West Paterson, N.J.); and EPO1, EPO3, F301, F402, and A303 sizing compositions from Toho Tenax Co, Ltd. (Menlo Park, Calif.).

In one desired embodiment of the present invention, the carbon tow is sized with a 40B sizing composition, a 40A sizing composition, or a 50B sizing composition from Toray Industries, Inc. (Tokyo, JP). Toray uses a number/letter system to identify sizing compositions. For example, the first number in the "40B" designation identifies the size composition chemistry, the second number identifies whether the size composition is a surface treatment or not, and the letter identifies the amount of the sizing composition. The "40B" size composition comprises (i) a size composition chemistry containing in combination epoxy resin, phenolic resin and BMI (the "4" type of sizing), (ii) a size composition in the form of a surface treatment (the "0" designation), and (iii) a sizing composition at a size level of 1.0 percent by weight (pbw) based on a total weight of the sized tow (the "B" designation). Desirably, the sizing composition of the carbon tow comprises a 40B size composition as defined above.

A number of commercially available carbon tows may be used in the present invention. Suitable commercially available carbon tows include, but are not limited to, the T800HB 6K carbon tow having a 40B sizing composition available from Toray Industries, Inc. (Tokyo, JP), and the IM7 carbon tow having a GP sizing composition available from Hexcel Corporation (Stamford, Conn.).

C. Exemplary Fabric Constructions

In one desired embodiment of the present invention, the second fabric of the interwoven fabric comprises T800HB carbon tows having a 40B sizing composition thereon in both the warp and fill directions of the second fabric. In a further desired embodiment of the present invention, the second fabric comprising T800HB carbon tow is interlocked with a first fabric comprising nickel-plated copper wires in both the warp and fill directions of the first fabric as described above.

In a further embodiment of the present invention, the second fabric of the interwoven fabric comprises carbon tows in the warp direction and carbon tows and glass yarns in the fill direction of the second fabric. In this embodiment, the glass yarns may be present as a tracer yarn that is interwoven with the second fabric and interlocks the second fabric with the first fabric. For example, the first fabric may comprise metal wires, and the glass yarns interlock with metal wires running in the warp direction of the first fabric (for example, instead of carbon tows interlocking with metal wire warp ends as shown in FIG. 1, glass yarn fill ends within the second fabric interlock with metal wire warp ends). In this embodiment, 100% of the metal wire is positioned above the carbon tows of the second fabric since the glass yarn of the second fabric is used to interlock with the metal wire of the first fabric.

In yet a further embodiment of the present invention, the second fabric of the interwoven fabric comprises PAN-derived carbon tows in the warp and fill directions of the second fabric, while the first fabric comprises pitch-derived carbon tows in the warp and fill directions of the first fabric. In this embodiment, the pitch-derived carbon tows potentially provide one or more desired properties to the interwoven fabric, such as electrical conductivity and EMI shielding.

As discussed above, in any of the interwoven fabrics of the present invention, each fabric of the interwoven fabric (i.e., the first and second fabrics) may independently comprise one or more types of materials, a distinct weave pattern, and a desired fabric weave density to provide desired properties in the overall interwoven fabric. For example, in the interwoven fabric describe above comprising a metal wire first fabric and a carbon tow/glass tracer yarn second fabric, the glass tracer yarn of the second fabric may represent as much as 50% of the total yarns in the second fabric or as little as 5% of the total yarns in the second fabric based on the total number of carbon tows and glass yarns. The glass tracer yarns may be present in the second fabric only as an interlocking component of the second fabric. In other words, each glass tracer yarn in the second fabric interlocks with the metal wire first fabric.

II. Fiber-Reinforced Materials

The present invention is also directed to fiber-reinforced materials comprising the interwoven fabric of the present invention. The fiber-reinforced materials may comprise a single layer of interwoven fabric or multiple layers of interwoven fabric alone or in combination with other fiber-containing layers. Suitable fiber-containing layers include, but are not limited to, woven fabrics, nonwoven fabrics, knitted fabrics, unidirectional fabrics, or a combination thereof. In one embodiment of the present invention, the interwoven fabric is combined with at least one additional fiber-containing layer to form a plurality of fiber-containing layers, wherein at least one outermost layer of the plurality of fiber-containing layers comprises the first fabric of the interwoven fabric. In this embodiment, the one or more additional fiber-containing layers may include any of the above-described fiber-containing layers including an additional interwoven fabric of the present invention.

The fiber-reinforced materials of the present invention may comprise an interwoven fabric, as described above, in combination with a matrix material in contact with the interwoven fabric. The degree of contact between the matrix material and the interwoven fabric may vary depending on the end use of the fiber-reinforced material. In one embodiment of the present invention, the matrix material comes into contact with, but does not encapsulate, the second fabric of the interwoven fabric. In a further embodiment of the present invention, the matrix material encapsulates the second fabric of the interwoven fabric, but not the first fabric. In yet a further embodiment of the present invention, the matrix material completely encapsulates the interwoven fabric.

A variety of matrix materials may be used in combination with the interwoven fabrics of the present invention to produce fiber-reinforced materials. Suitable matrix materials include, but are not limited to, thermosettable resins (e.g., epoxy resins, vinyl esters, etc.), thermoset resins, thermoplastic materials, metals, ceramics, concrete, or combinations thereof. In one desired embodiment of the present invention, the matrix material comprises a thermosettable or a thermoset epoxy resin.

A number of commercially available epoxy resin systems may be used in the present invention. Suitable epoxy resin systems include, but are not limited to, epoxy resin systems HX1610-1, M21, and 8552 from Hexcel Corporation (Stamford, Conn.), and epoxy resin system F3900 from Toray Industries, Inc. (Tokyo, JP). In one desired embodiment of the present invention, the matrix comprises an F3900 epoxy resin system.

The fiber-reinforced materials of the present invention may comprise from about 5 to about 95 percent by weight (pbw) of fiber-containing layers including at least one interwoven fabric layer, and from about 95 to 5 pbw of at least one matrix material, wherein the weight percentages are based on a total weight of the fiber-containing layers and the matrix material. Typically, the fiber-reinforced materials of the present invention comprise from about 40 to about 80 pbw of one or more fiber-containing layers including at least one interwoven fabric layer, and from about 60 to about 20 pbw of at least one matrix material, wherein the weight percentages are based on a total weight of the fiber-containing layers and the matrix material. In one desired embodiment, the fiber-reinforced materials comprise about 60 pbw of one or more fiber-containing layers including at least one interwoven fabric layer, and about 40 of at least one matrix material, such as an epoxy resins system, wherein the weight percentages are based on a total weight of the fiber-containing layers and the matrix material.

In one embodiment of the present invention, prepregs comprising an interwoven fabric of the present invention within an epoxy resin matrix are provided. In this embodiment, the epoxy resin is a curable, B-staged epoxy resin, which may be further cured by applying additional heat and/or pressure. The prepregs of the present invention may be combined with other fiber-containing layers and/or fiber-containing prepregs to produce various articles of manufacture. In one desired embodiment of the present invention, the article of manufacture is a component of an aircraft. When used as an outer layer of the aircraft component, the interwoven fabric of the present invention provides exceptional lightning strike properties to the resulting aircraft component.

Other articles of manufacture may be prepared from the fiber-reinforced materials of the present invention. Suitable articles of manufacture include, but are not limited to, commercial, military, and civil aviation components (i.e., aircraft and components of aircraft), wind energy components (i.e., wind propellers for generating energy), etc.

Articles of manufacture may be prepared from the fiber-reinforced materials of the present invention by any known method of combining the interwoven fabrics of the present invention with an additional article component, such as one or more of the above-described matrix materials. In addition to the preparation of prepregs, articles of manufacture containing the fiber-reinforced materials of the present invention may also be formed using other techniques such as resin transfer molding (RTM), resin film infusion (RFI), pultrusion, extrusion, etc.

III. Methods of Making an Interwoven Fabric

The present invention is further directed to methods of making the above-described interwoven fabric. One exemplary method of making an interwoven fabric of the present invention may be described in reference to exemplary interwoven fabric 10 of FIG. 1. As shown in FIG. 1, exemplary interwoven fabric 10 comprises a first set of m warp ends (i.e., metal wires) and a second set of n warp ends (i.e., carbon tows). The first set of m warp ends and the second set of n warp ends may be taken off the same creel or two separate creels and fed into a loom. In the case of exemplary interwoven fabric 10, every other warp end fed into the loom is from the first set of m warp ends, while every other warp end comprises an end from the second set of n warp ends (i.e., alternating metal wire warp ends and carbon tow warp ends are fed into the loom). A description of a weaving process for weaving exemplary interwoven fabric 10 will be described in reference to fill ends 21 through 30 of FIG. 1.

Each warp end of the first set of in warp ends and each warp end of the second set of n warp ends is threaded through the eye of a heddle. Every individual heddle is attached to a given harness. Multiple harnesses are used to produce a given interwoven fabric. For example, 8 harnesses are used to weave exemplary interwoven fabric 10 shown in FIG. 1. Movement of individual harnesses in an up and down direction relative to other harnesses creates a shed for an individual fill end to enter into. Once a fill end has been inserted into a shed, a reed beats (i.e., pushes) the newly laid fill end into a body of the interwoven fabric.

Beginning with the insertion of metal wire fill end 21 into exemplary interwoven fabric 10, a shed (referred to herein as $shed_{21}$) is created by the following movements of one or more harnesses: (i) moving every other metal wire warp end of the first set of m warp ends into an up position, (ii) moving the remaining metal wire warp ends of the first set of m warp ends (i.e., alternating or every other warp end) into a down position, and (iii) moving all of the carbon tow warp ends of the second set of n warp ends into a down position. Metal wire fill end 21 is inserted into $shed_{21}$. After a reed beats fill end 21 into the body of exemplary interwoven fabric 10, the harnesses move to create a new shed for carbon tow fill end 22.

The shed created for carbon tow fill end 22 (referred to herein as $shed_{22}$) is created by the following movements of one or more harnesses: (i) moving all of the metal wire warp ends of the first set of m warp ends into an up position, (ii) moving every other carbon tow warp end within the second set of n warp ends into an up position, and (iii) moving the remaining carbon tow warp ends (i.e., every other warp end)

of the second set of n warp ends into a down position. Carbon tow fill end 22 is inserted into newly created $shed_{22}$ and the reed beats newly laid carbon tow fill end 22 into the body of the fabric.

Since exemplary interwoven fabric 10 comprises a first fabric 31 having a plain weave pattern, the next shed created for metal wire fill end 23 (referred to herein as $shed_{23}$) is created by the following movements of one or more harnesses: (i) moving the metal wire warp ends of the first set of m warp ends that were in a down position for $shed_{21}$ into an up position, (ii) moving the remaining metal wire warp ends of the first set of m warp ends (i.e., the metal warp ends that were in an up position for $shed_{21}$) into a down position, and (iii) moving all of the carbon tow warp ends of the second set of n warp ends into a down position. Metal wire fill end 23 is then inserted into newly created $shed_{23}$, and beaten into the body of exemplary interwoven fabric 10 by a reed.

The next shed created for carbon tow fill end 24 (referred to herein as $shed_{24}$) represents the first interlocking shed in the present description of the weaving process for producing exemplary interwoven fabric 10. $Shed_{24}$ for receiving carbon tow fill end 24 is created by the following movements of one or more harnesses: (i) moving all of the carbon tow warp ends within the second set of n warp ends that were in an up position for $shed_{22}$ into a down position, (ii) moving the remaining carbon tow warp ends of the second set of n warp ends (i.e., the carbon tow ends that were in a down position for $shed_{22}$) into an up position, and (iii) moving every fourth metal warp end within the first set of m warp ends into a down position. Carbon tow fill end 24 is inserted into newly created $shed_{24}$ to interlock first fabric 31 with second fabric 32. Inserted carbon tow fill end 24 of second fabric 32 interlocks with metal wire warp ends of first fabric 31 at locations 19 and 20 as shown in FIG. 1.

The next shed created for the insertion of metal wire fill end 25 into exemplary interwoven fabric 10 (referred to herein as $shed_{25}$) is created by the same harness movements as described above during the insertion of metal fill end 21 into $shed_{21}$. The next shed created for the insertion of carbon tow fill end 26 into exemplary interwoven fabric 10 (referred to herein as $shed_{26}$) is created by the same harness movements as described above during the insertion of carbon tow fill end 22 into $shed_{22}$. The next shed created for the insertion of metal wire fill end 27 into exemplary interwoven fabric 10 (referred to herein as $shed_{27}$) is created by the same harness movements as described above during the insertion of metal fill end 23 into $shed_{23}$.

The next shed created for carbon tow fill end 28 (referred to herein as $shed_{28}$) is created by the following movements of one or more harnesses: (i) moving all of the metal wire warp ends within the first set of m warp ends into an up position, (ii) moving all of the carbon tow warp ends within the second set of n warp ends that were in an up position for $shed_{26}$ into a down position, and (iii) moving the remaining carbon tow warp ends of the second set of n warp ends (i.e., the carbon tow ends that were in a down position for $shed_{26}$) into an up position. Carbon tow fill end 28 is inserted into newly created $shed_{28}$.

The next shed created for the insertion of metal wire fill end 29 into exemplary interwoven fabric 10 (referred to herein as $shed_{29}$) is created by the same harness movements as described above during the insertion of metal fill end 25 into $shed_{25}$. The next shed created for carbon tow fill end 30 (referred to herein as $shed_{30}$) represents the second interlocking shed in the present description of the weaving process for producing exemplary interwoven fabric 10. $Shed_{30}$ for receiving carbon tow fill end 30 is created by the following movements of one or more harnesses: (i) moving the carbon tow warp ends within the second set of n warp ends into up and down positions similar to $shed_{26}$, and (ii) moving every fourth metal wire warp end within the first set of m warp ends into a down position, wherein every fourth metal wire warp end selected is to the immediate left of the interlocked metal wire warp ends interlocked by carbon tow fill end 24. Carbon tow fill end 30 is inserted into newly created $shed_{30}$ to interlock first fabric 31 with second fabric 32 at locations 17 and 18 as shown in FIG. 1.

For production of exemplary interwoven fabric 10, the above-described weaving process is repeated for insertion of alternate metal wire fill ends and carbon tow fill ends. At each interlocking shed, every fourth metal wire warp end within the first set of m warp ends is moved into a down position, wherein the selected metal wire warp ends are to the immediate left of the interlocked metal wire warp ends interlocked during the previous interlocking step.

Figure 2B:
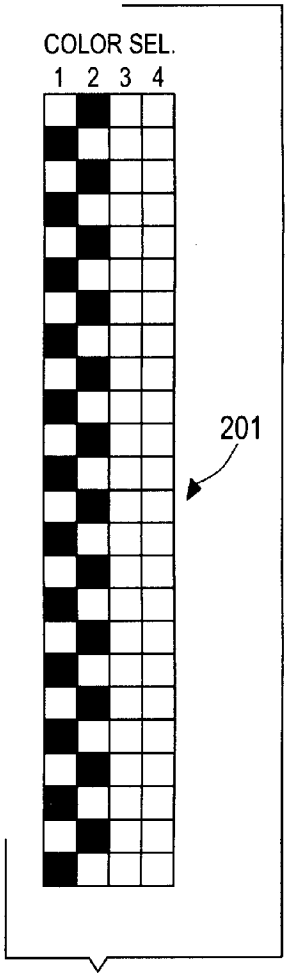
FIGS. 2A-2C depicts an exemplary Pattern Chain Draft used to produce the exemplary interwoven fabric shown in FIG. 1.
Figure 2A:
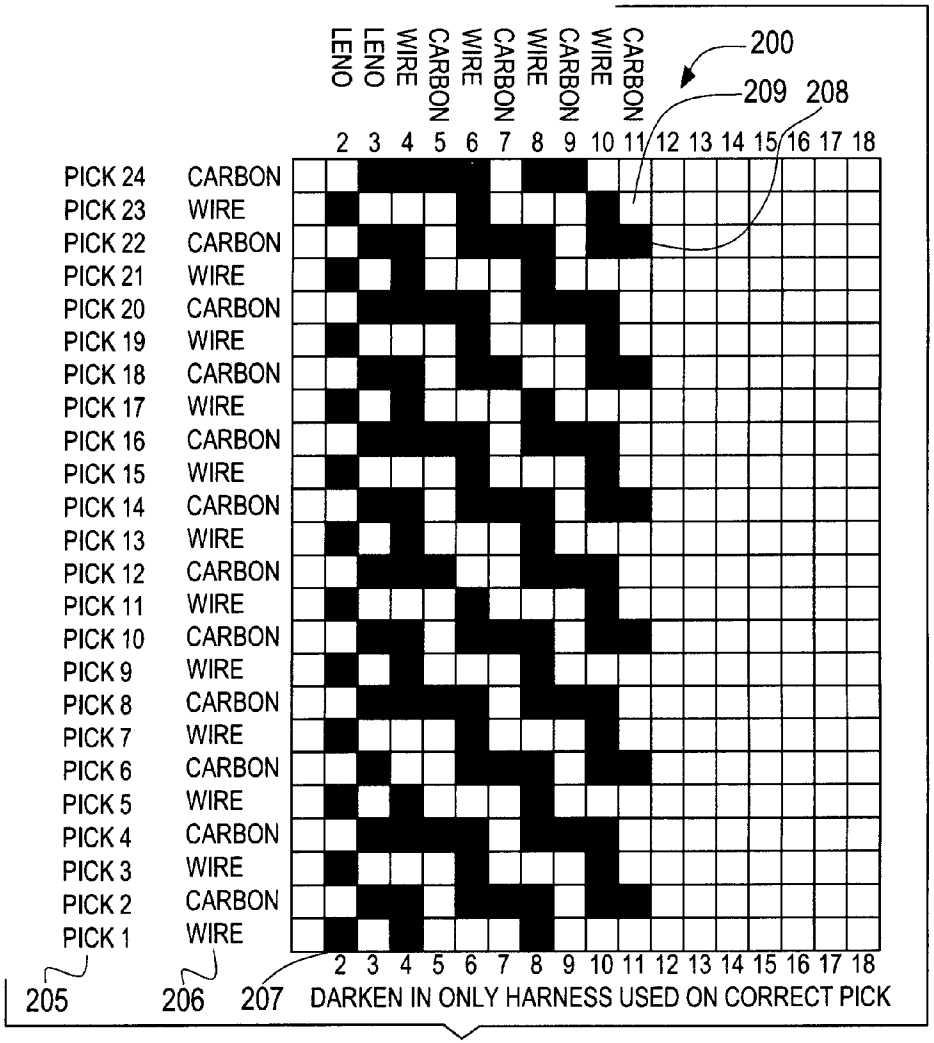
Figure 2C:
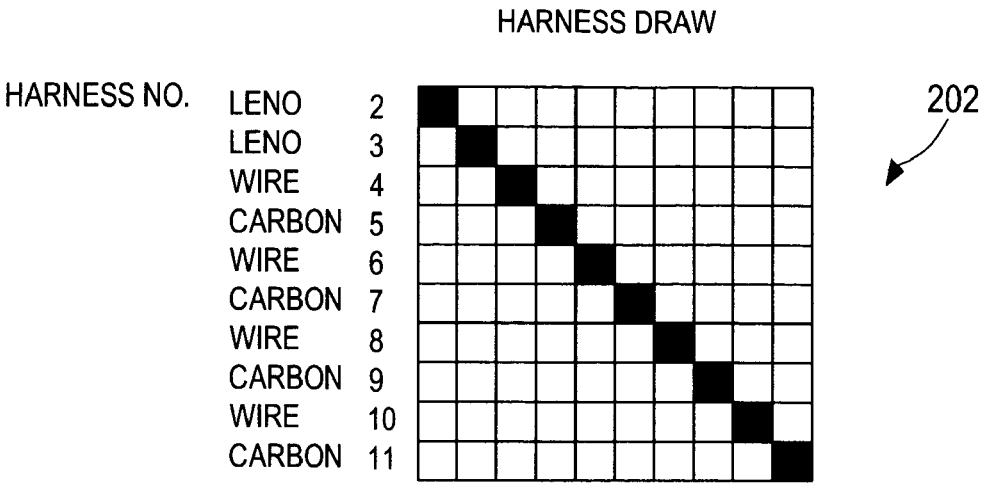

The weaving process for producing exemplary interwoven fabric 10 may also be understood by reviewing the pattern chain draft components shown in FIGS. 2A-2C. Textile design engineers typically use pattern chain draft components, such as those shown in FIGS. 2A-2C, to design a given woven fabric. As shown in FIGS. 2A-2C, pattern chain draft components include a pattern chain draft 200 (FIG. 2A), a color select pattern 201 (FIG. 2B), and a harness draw pattern 202 (FIG. 2C). Pattern chain draft 200 of FIG. 2A comprises pick display 205, yarn/tow configuration 206, harness pattern 207, shaded areas 208, which indicate that a given harness is in an "up" position, and unshaded areas 209, which indicate that a given harness is not in an "up" position.

Given the exemplary pattern chain draft components shown in FIGS. 2A-2C, a textile design engineer would be able to reproduce exemplary interwoven fabric 10 shown in FIG. 1 without the above description of the weaving process for producing exemplary interwoven fabric 10.

As discussed above, the interwoven fabric of the present invention may be produced using a weaving procedure as described above to produce a first fabric having a first weave pattern, a second fabric having a second weave pattern, and an interlocking weave pattern selected from any of the above-described weave patterns. The upward and downward movements of one or more harnesses during the insertion of each fill end results in a given weave pattern for the first fabric, the second fabric, and the interlocking weave pattern. Further, the upward and downward movements of one or more harnesses may be used to control the degree of interlocking between the first fabric and the second fabric of the interwoven fabric of the present invention.

The above-described interwoven fabrics of the present invention and methods of making the same may be woven on a variety of weaving machines. Suitable types of weaving machines include, but are not limited to, water jet, air jet, projectile, shuttle-fly, and rigid and flexible rapiers. The above types of weaving machines are commercially available from a number of manufacturers including, but not limited to, Dornier (e.g., air jet and rapiers looms) and Sulzer-Ruti (e.g., air jet looms). The type of weaving machine used will depend on a number of factors including, but not limited to, the type of yarns/tows used, the density of the fabric weave, etc. In one desired embodiment of the present invention, a Dornier Rapier Loom is used to prepare the interwoven fabrics of the present invention.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Preparation of a Metal Wire/Carbon Tow Interwoven Fabric

A metal wire/carbon tow interwoven fabric having a weave pattern as shown in FIG. 1 was prepared using the pattern chain draft components as shown in FIGS. 2A-2C. The fabric details are given in Table 1 below.

TABLE 1

Interwoven Fabric Specifications

| | Value | Tolerance |
|---|---|---|
| Weave: | Double Plain | none |
| Warp yarn: | T800HB 6K 40B | none |
| Warp yarn: | C11000HD, Ni-Plated Cu, 0.004" dia. | none |
| Fill yarn: | T800HB 6K 40B | none |
| Fill yearn: | C11000HD, Ni-Plated Cu, 0.004" diam. | none |
| Ends/inch: | 11.0 | +/−0.5 |
| Ends/inch: | 11.0 | +/−0.5 |
| Picks/inch: | 11.0 | +/−0.5 |
| Picks/inch: | 11.0 | +/−0.5 |
| Areal weight (carbon only): | 196 gsm | +/−0.5 |
| Area weight (carbon & wire): | 260 gsm | +/−8 |
| Width: | 38" | +/−½" |

In the resulting interwoven fabric, approximately 95% of the metal wire first fabric was positioned on top of the carbon tow second fabric.

EXAMPLE 2

Preparation of a Metal Wire/Carbon Tow Interwoven Fabric

The metal wire/carbon tow interwoven fabric of Example 1 was prepared except Hexcel IM7 GP 6K carbon tows were used in place of the T800HB 6K 40B carbon tows.

EXAMPLE 3

Preparation of a Metal Wire/Carbon Tow Interwoven Fabric Prepreg

A metal wire/carbon tow interwoven fabric prepreg was prepared by impregnating the interwoven fabric of Example 1 with an epoxy resin commercially available under the trade designation M21 resin from Hexcel Corporation (Stamford, Conn.). The resulting prepreg comprised about 62 wt % of interwoven fabric and about 38 wt % epoxy resin based on a total weight of the prepreg. The resulting prepreg had a basis weight of 417 grams per square meter (gsm).

EXAMPLE 4

Preparation of a Metal Wire/Carbon Tow Interwoven Fabric Prepreg

A metal wire/carbon tow interwoven fabric prepreg was prepared as in Example 3 except the interwoven fabric of Example 1 was impregnated with the epoxy resin system F3900 from Toray Industries, Inc. (Tokyo, JP). The resulting prepreg comprised about 65 wt % of interwoven fabric and about 35 wt % epoxy resin based on a total weight of the prepreg. The resulting prepreg had a basis weight of 401 grams per square meter (gsm).

EXAMPLE 5

Preparation of a Fiber-Reinforced Composite Part

A fiber-reinforced composite part was prepared by stacking the prepreg of Example 4 onto a stack of ten unidirectional tapes of carbon tows impregnated with the epoxy resin system F3900 from Toray Industries, Inc. (Tokyo, JP). The metal wire first fabric of the interwoven fabric was on an outer layer of the stack of prepregs. The stack of prepregs was subjected to heat and pressure to form a fiber-reinforced composite part.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. An interwoven fabric consisting essentially of:

(a) a first woven fabric consisting essentially of (i) a first set of m warp ends consisting essentially of metal wires and (ii) a first set of y fill ends consisting essentially of metal wires, wherein each warp end in said first set of m warp ends contacts each fill end in said first set of y fill ends so as to form a metal grid positioned within a first plane, (b) a second woven fabric consisting essentially of (i) a second set of n warp ends consisting essentially of carbon tows and (ii) a second set of z fill ends consisting essentially of carbon tows, wherein said second woven fabric is positioned within a second plane, said second plane being parallel with and below said first plane, wherein at least one of said n warp ends or at least one of said z fill ends extends from said second plane into and through said first plane and back into said second plane so as to interlock with at least one of said y fill ends or at least one of said m warp ends of said first woven fabric.

2. The interwoven fabric of claim 1, wherein less than about 10% of the warp ends within the first set of warp ends are interwoven with the second set of fill ends.

3. The interwoven fabric of claim 1, wherein the ends of the second set of warp ends are not interwoven with the ends of the first set of fill ends.

4. The interwoven fabric of claim 1, wherein less than about 10% of the warp ends within the second set of warp ends are interwoven with the first set of fill ends.

5. The interwoven fabric of claim 1, wherein:

(a) each warp end within the first set of m warp ends consists of a metal wire, (b) each warp end within the second set of n warp ends consists of a carbon tow, (c) each fill end within the first set of y fill ends consists of a metal wire, and (d) each fill end within the second set of z fill ends consists of a carbon tow.

6. The interwoven fabric of claim 1, wherein the first fabric consists essentially of an open woven mesh of metal wire, and the second fabric consists essentially of a woven carbon fabric.

7. The interwoven fabric of claim 1, wherein m equals n, and y equals z.

8. The interwoven fabric of claim 1, wherein m, n, y and z each independently range from about 1 to about 12 ends per inch.

9. A fiber reinforced material comprising:
the interwoven fabric of claim 1; and
a matrix material encapsulating at least part of the interwoven fabric.

10. The fiber reinforced material of claim 9, wherein said matrix material comprises a thermosettable or thermoset epoxy resin.

11. An aircraft component comprising the interwoven fabric of claim 1.

12. The interwoven fabric of claim 1, wherein m and y each independently range from about 1 to about 3 ends per inch, and n and z each independently range from about 24 to about 60 ends per inch.

13. An article of manufacture comprising the interwoven fabric of claim 1.

14. The article of manufacture of claim 13, wherein the article comprises comprising a wind propeller, a vehicle component, or an aircraft component.

15. A plurality of fiber-containing layers, wherein at least one outermost layer of the plurality of fiber-containing layers comprises the first fabric of the interwoven fabric of claim 1.

16. The plurality of fiber-containing layers of claim 15, wherein the metal wires of the first fabric of the interwoven fabric extend along an outer surface of the at least one outermost layer.

17. A fiber reinforced material comprising:
the plurality of fiber-containing layers of claim 15; and
a matrix material encapsulating at least part of the interwoven fabric.

18. The fiber reinforced material of claim 17, wherein said matrix material comprises a thermosettable or thermoset epoxy resin.

19. The fiber reinforced material of claim 17, wherein the metal wires of the first fabric of the interwoven fabric extend along an outer surface of the at least one outermost layer.

20. An article of manufacture comprising fiber reinforced material of claim 19.

21. The article of manufacture of claim 20, wherein the article of manufacture comprises a wind propeller, a vehicle component, or an aircraft component.

22. The article of manufacture of claim 21, wherein the article of manufacture comprises an aircraft component.

23. An interwoven fabric comprising:
(a) metal wire first warp ends interwoven with metal wire first fill ends to form a first fabric, wherein each metal wire first warp end contacts each metal wire first fill end so as to form a metal wire grid positioned within a first plane, and
(b) carbon tow second warp ends interwoven with carbon tow second fill ends to form a second fabric, wherein said second fabric is positioned within a second plane, said second plane being parallel with and below said first plane,
wherein at least one of said carbon tow second warp ends or at least one of said carbon tow fill ends extends from said second plane into and through said first plane and back into said second plane so as to interlock with at least one of said metal wire first fill ends or at least one of said metal wire first warp ends of said first fabric, and
wherein each of the first and second fabrics may further comprise metal wire, carbon tows, fibers or yarns, aramid fibers or yarns, fiberglass fibers or yarns, quartz fibers or yarns, ceramic fibers or yarns, or a combination thereof.

24. The interwoven fabric of claim 23, wherein each of the first warp ends and the first fill ends comprises metal wire, each of the second warp ends and the second fill ends comprises carbon tow, and the second fabric further comprises glass tracers yarns running in a fill direction of the second fabric and interlocking with at least one end of the first fabric.

25. The interwoven fabric of claim 24, wherein 100% of the metal wire ends of the first fabric are positioned above 100% of the carbon tow ends of the second fabric.

26. An interwoven fabric consisting essentially of:
(a) a first woven fabric consisting essentially of (i) a first set of m warp ends consisting essentially of metal wires or pitch-derived carbon tows and (ii) a first set of y fill ends consisting essentially of metal wires or pitch-derived carbon tows, wherein each warp end in said first set of m warp ends contacts each fill end in said first set of y fill ends so as to form a metal or pitch-derived carbon tow grid positioned within a first plane,
(b) a second woven fabric consisting essentially of (i) a second set of n warp ends consisting essentially of carbon tows and (ii) a second set of z fill ends consisting essentially of carbon tows alone or in combination with glass tracer yarns, wherein said second woven fabric is positioned within a second plane, said second plane being parallel with and below said first plane,
wherein at least one of said n warp ends or at least one of said z fill ends extends from said second plane into and through said first plane and back into said second plane so as to interlock with at least one of said y fill ends or at least one of said m warp ends of said first woven fabric.

27. The interwoven fabric of claim 26, wherein at least 95 percent by weight of the metal wire or pitch-derived carbon tow ends of the first fabric are positioned above the second plane.

28. A fiber reinforced material comprising:
the interwoven fabric of claim 27; and
a matrix material encapsulating at least part of the interwoven fabric.

29. The fiber reinforced material of claim 28, wherein said matrix material comprises a thermosettable or thermoset epoxy resin.

30. The interwoven fabric of claim 26, wherein:
(a) each warp end within the first set of m warp ends consists essentially of pitch-derived carbon tows,
(b) each warp end within the second set of n warp ends consists essentially of PAN-derived carbon tows,
(c) each fill end within the first set of y fill ends consists essentially of pitch-derived carbon tows, and
(d) each fill end within the second set of z fill ends consists essentially of PAN-derived carbon tows alone or in combination with glass tracer yarns.

31. An article of manufacture comprising the interwoven fabric of claim 30.

32. A fiber reinforced material comprising:
the interwoven fabric of claim 30; and
a matrix material encapsulating at least part of the interwoven fabric.

33. The fiber reinforced material of claim 32, wherein said matrix material comprises a thermosettable or thermoset epoxy resin.

34. An article of manufacture comprising fiber reinforced material of claim 33.

35. The article of manufacture of claim 34, wherein the article of manufacture comprises a wind propeller, a vehicle component, or an aircraft component.

* * * * *